United States Patent [19]

Nat

[11] 4,408,109

[45] Oct. 4, 1983

[54] LATCH DOWN DEVICE FOR PUSH-BUTTON SWITCHES

[75] Inventor: Gursharan P. S. Nat, Smithfield, N.C.

[73] Assignee: Eaton Corporation, Cleveland, Ohio

[21] Appl. No.: 321,002

[22] Filed: Nov. 13, 1981

[51] Int. Cl.[3] ..... H01H 13/56

[52] U.S. Cl. ..... 200/153 J; 200/328

[58] Field of Search ..... 200/153 J, 159 R, 323, 200/324, 325, 328

[56] References Cited

U.S. PATENT DOCUMENTS

| | | | |
|---|---|---|---|
| 2,873,334 | 2/1959 | Wirsching | 200/325 |
| 4,012,615 | 3/1977 | Ryden | 200/325 |
| 4,238,653 | 12/1980 | Brandt | 200/153 J |

FOREIGN PATENT DOCUMENTS

| | | | |
|---|---|---|---|
| 193856 | 1/1965 | Sweden | 200/328 |

*Primary Examiner*—John W. Shepperd

*Attorney, Agent, or Firm*—C. H. Grace; L. G. Vande Zande

[57] ABSTRACT

A leaf spring (26, 66) is mounted under compression to be bowed to a first bistable position against a push button surface (10*b*, 40*c*) to engage a latch surface (10*d*, 40*d*) upon depression of the button (10, 40) to an intermediate position and to be driven to a second bistable position by a cam (10*e*, 40*e*) upon subsequent further depression of the button (10, 40) to release the button. Bridging contacts (14, 44) are held closed upon stationary contacts (18, 20, 48, 50) when the button is latched. A drive spring (12, 42) forms a resilient connection between the push button (10, 40) and the switch contact mechanism.

16 Claims, 12 Drawing Figures

Fig. 8
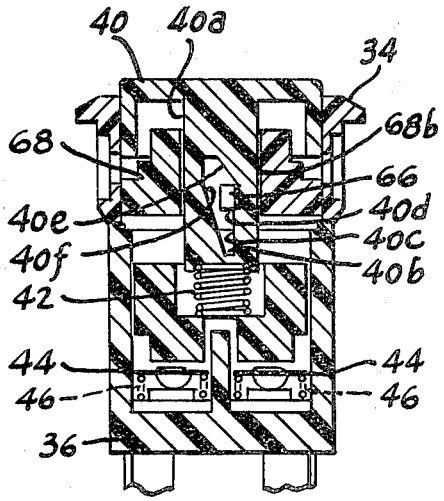
Fig. 9
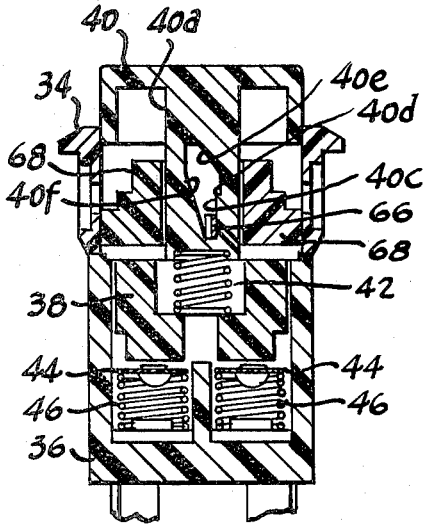
Fig. 10
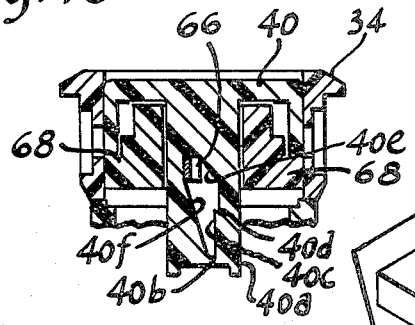
Fig. 11
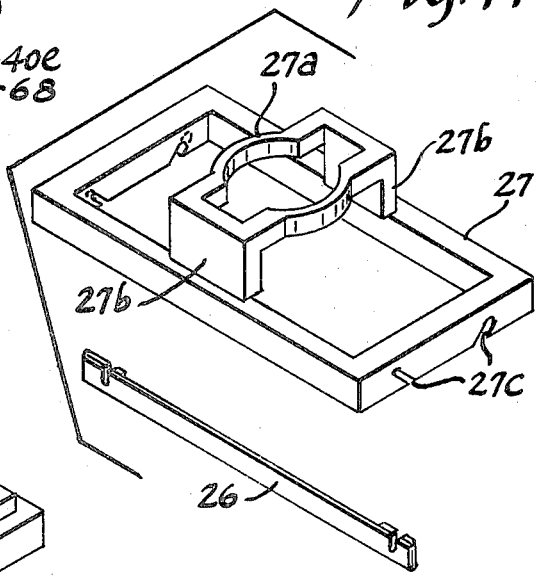
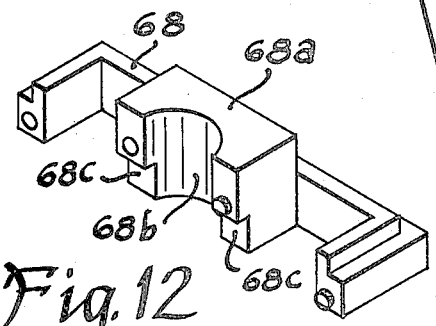
Fig. 12

LATCH DOWN DEVICE FOR PUSH-BUTTON SWITCHES

BACKGROUND OF THE INVENTION

This invention relates to push button switches of the alternate action type, commonly known as push-push switches. More particularly it relates to a bi-stable latch down mechanism for such switches wherein the button is latched in an operated position upon a first depression to an intermediate position thereof and is released to return to its original position upon subsequent depression to a fully depressed position.

One such switch is shown in U.S. Pat. No. 2,873,334. A snap disc diaphragm carries a cantilevered U-shaped latch member which is biased into engagement with the push button stem in one stable position of the diaphragm and releases the stem in the other stable position of the diaphragm. This device fulfills its intended purpose, but the snap disc diaphragm requires that the housing have a cylindrical configuration to receive the diaphragm. Moreover, attachment of the latch to the diaphragm requires a sub-assembly operation which adds to the cost of the switch. A potential shortcoming of this design is that it could lose some rigidity or adjustment due to weakening or bending of the leg portions of the latch or loosening at the points of attachment to the diaphragm.

Another latching mechanism is shown in U.S. Pat. No. 4,012,615 wherein a wire member is secured to lie along side the reduced diameter stem of an axially movable member. Inward movement of the axially movable member causes a conical surface thereon to cam the spring away from its normal position until such time as an annular latching surface passes below the spring whereupon the spring may return to its initial position, overlying the latching surface and latching the axially movable member in its inward position. This latching device requires a separate release member to operate upon the spring for pushing the spring back against its bias and clear of the latching surface to release the axially movable member. A further drawback to latching devices of this type is that the inward movement of the axially movable member must overcome an increasing resistance to that movement by the camming action of the conical portion against the spring.

A still further type of latching device for a push-button switch may be seen in U.S. Pat. No. 4,238,653. This patent shows a push button having a transverse opening through which a wire extends. The wire is fixed at one end in the base of the switch and at the other end is positioned in a heart-shaped cam groove. Depression of the push button drives the wire along the track of the cam groove whereupon the cam and wire cooperate to latch the switch in a depressed position, and subsequent depression and release permit the button and wire to return to the original position. This type of latching mechanism provides some resilience of the button in its latched down position by the inherent flexibility of the cylindrical wire. While the foregoing switches are all useful for their intended purposes, this invention relates to improvements thereover.

SUMMARY OF THE INVENTION

This invention provides a flat leaf spring arranged to project across the opening of a switch housing to lie adjacent to a push button stem. The leaf spring is fixed at its opposite ends in a compressed state such that it is bowed slightly and is therefore bi-stable. The spring is positioned to engage cam surfaces on the stem of the push button to bias the spring to one stable position or the other. In one stable position the spring operates to engage a latch surface of the push button to hold that push button in an intermediate depressed position. Subsequent further depression of the push button cams the leaf spring to the other stable position to release the push button. Movement to the extended position of the push button resets the spring to the first mentioned stable position. In a first version the spring is mounted in an oblique plane across the housing opening and in a second version the spring is mounted in an upright or vertical plane across the housing opening to provide maximum latching force in the vertical direction.

BRIEF DESCRIPTION OF THE DRAWINGS

FIG. 8 is a transverse cross-sectional view of the switch of FIGS. 6 and 7 taken along the line 8—8 in FIG. 7 showing the switch latched in an intermediate, switch ON position;

FIG. 9 is a transverse cross-sectional view similar to FIG. 8 but showing the switch in its OFF position;

FIG. 10 is a partial sectional view similar to FIGS. 8 and 9 and showing the push button and leaf spring latch member in a fully depressed, latch resetting position;

FIG. 11 is an isometric view of a leaf spring and a spring retainer/button guide used in the switch of FIGS. 1–5; and FIG. 12 is an isometric view of a leaf spring retainer used in the alternate version of switch shown in FIGS. 6–10.

DESCRIPTION OF THE PREFERRED EMBODIMENT

Figure 1:
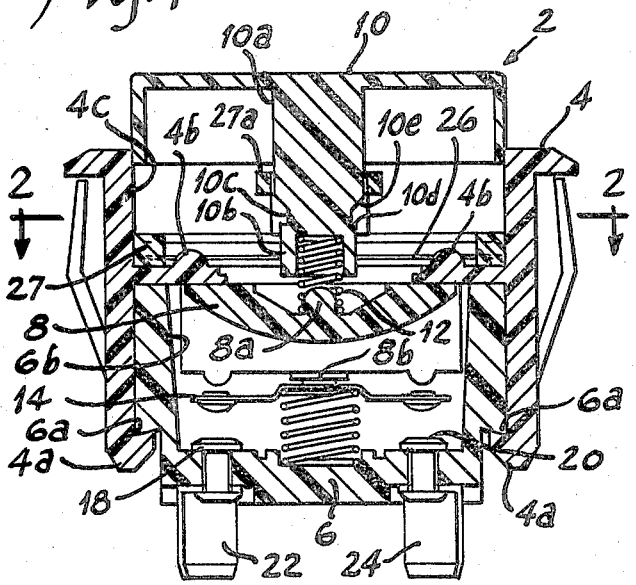
FIG. 1 is a longitudinal cross-sectional view of the switch of this invention shown in its OFF position.

The latch down device of this invention is disclosed in conjunction with a double pole push button switch 2. Switch 2 comprises a molded insulating frame 4 and a molded switch base 6 which is snap fit to the frame 4 such that projections **6*a* on the base are engaged by depending legs 4*a* of the switch frame. A contact carrier 8 is floatably guided in the cavity 6*b* of the switch base and a push button 10 is entrapped in the switch frame 4 for movement inward of the frame toward the base 6. Push button 10 includes a depending centrally located stem 10*a* having a cylindrical recess opening to the lower end thereof to receive one end of a helical compression drive spring 12 therein. The contact carrier 8** has a centrally located boss 8*a* around which is disposed the other end of drive spring 12. The underside of contact carrier 8 is provided with a pair of depending bosses 8*b* (FIGS. 1 and 3) which serve as guide members for a pair of bridging contacts 14. Each contact 14 is biased to carrier 8 by helical compression springs 16 which extend between the bottom of cavity 6*b* and the central positions of the bridging contacts 14. Springs 16 also serve to bias the contact carrier 8 to its uppermost position against overhanging ledges 4*b* of the frame. Cooperating pairs of stationary contacts 18, 20 are mounted in the bottom wall of base 6 to be engaged by the respective bridging contacts 14. The stationary contacts 18, 20 each comprise a rivet having a headed end in the cavity 6*b* which serves as the contact face and a tubular portion extending through the bottom wall of base 6 and through respective terminals 22, 24. The projecting ends of the tubular portions are riveted over to secure the terminals to the base and to the respective stationary contact.

Figure 2:
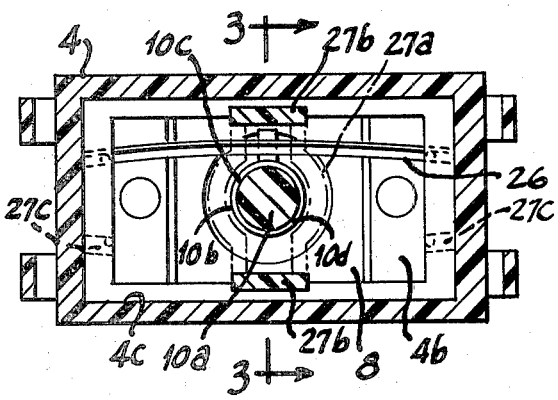
FIG. 2 is a cross-sectional view taken along the line 2—2 of FIG. 2 showing the latching leaf spring of this invention positioned with respect to the stem of a push button for the switch.

The upper portion of switch frame 4 has a substantially rectangular opening 4*c* which receives the push button 10 therein. A flat leaf spring 26 is positioned in an oblique plane to extend across the lengthwise dimension of rectangular opening 4*c* by a combined spring retainer and button guide member 27. Referring particularly to FIG. 11, retainer/guide member 27 essentially comprises a rectangular frame which is press fit into the opening 4*c* to engage the peripheral walls defining the opening. A guide portion 27*a*, shown in phantom lines in FIG. 2, extends laterally across the opening 4*c* upon upstanding legs 27*b*. Portion 27*a* has an opening therein for receiving and guiding stem 10*a* of push button 10. The short sides of member 27 each have two spring receiving grooves 27*c* formed therein, only one appearing in FIG. 3. The grooves 27*c* are open to the bottom of member 27 and the ends thereof adjacent to the internal peripheral edge of member 27 are partially closed to create a tongue in each groove. Moreover grooves 27 are obliquely disposed to establish the oblique plane for the leaf spring 26. The ends of leaf spring 26 are notched to be complimentally received by the tongues within grooves 27*c*, the spring being installed in one directly opposite pair of grooves. The second directly opposite pair of grooves establishes symmetry for the retainer/-guide member 27 to permit it to be assembled in the opening 4*c* in either of two positions displaced by 180°. The leaf spring 26 is assembled in the member 27 under compression wherein it is bowed to a first stable position as shown in FIG. 2. As also shown in FIG. 2, when spring 26 and member 27 are pressed into frame opening 4*c* the leaf spring 26 is positioned to one side of center of the frame opening 4*c* to lie alongside the depending stem 10*a* of push button 10.

The stem of push button 10 is provided with cam surfaces which cooperate with leaf spring 26 to provide the latch down and release operation. The outer most end of stem 10*a* has a right cylindrical surface 10*b* joined to a second right cylindrical surface 10*c* of reduced diameter by an annular shoulder 10*d*. A frusto-conical portion 10*e* extends from surface 10*c* to the main portion of stem 10*a*. As seen in FIGS. 2–5, the lower most end of stem 10*a* includes a radially extending nib 10*f* which is angled in the upward direction substantially parallel to the frusto-conical surface 10*e* and to the oblique plane of spring 26.

Figure 3:
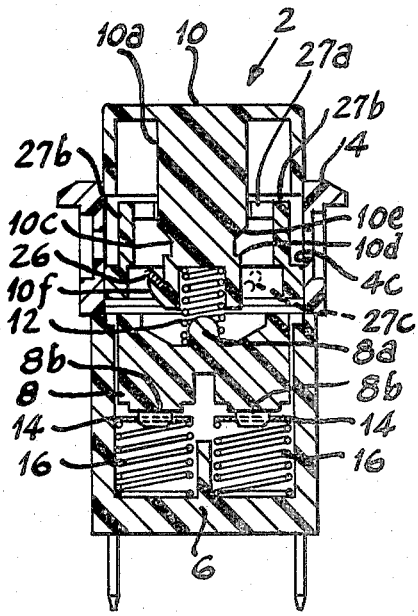
FIG. 3 is a transverse cross-sectional view taken substantially along the line 3—3 of FIG. 2 showing the switch in its OFF position.
Figure 4:
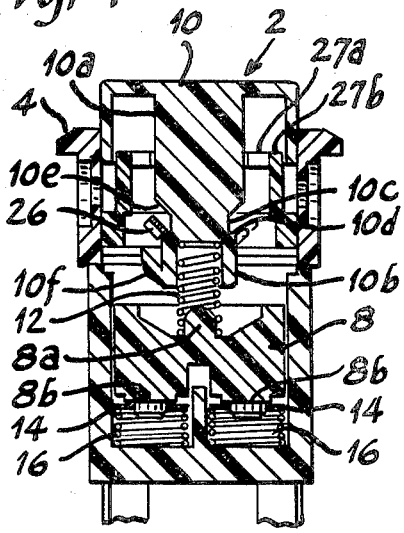
FIG. 4 is a view similar to FIG. 3 showing the switch latched in an intermediate, switch ON position.
Figure 5:
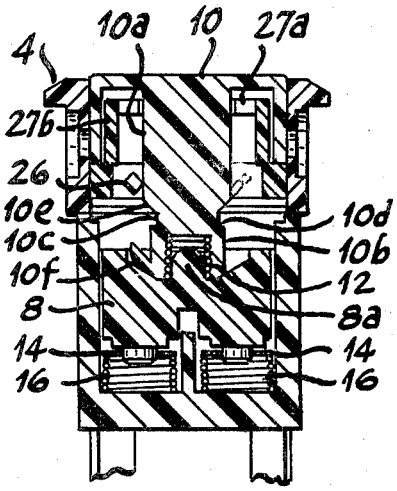
FIG. 5 is a view similar to FIGS. 3 and 4, but showing the switch in a fully depressed, latch resetting position.
Figure 6:
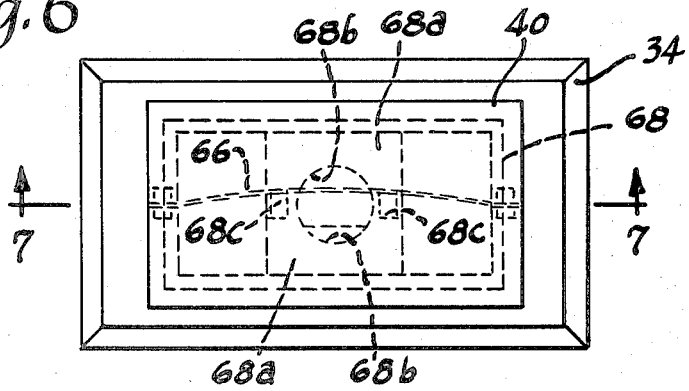
FIG. 6 is a top plan view of the switch of this invention showing an alternate version of the latch spring in dotted line.
Figure 7:
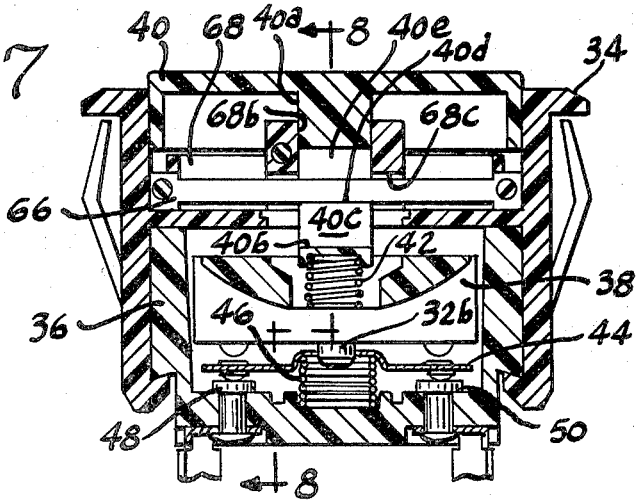
FIG. 7 is a cross-sectional view of the switch of FIG. 6 taken along the line 7—7 thereof.

Referring now to FIGS. 3, 4 and 5, it can be seen in FIG. 3 that the switch 2 is shown in its OFF position wherein the bridging contacts 14 are separated from the stationary contacts 18, 20 and the carrier 8 and the push button 10 are in their outermost extended position. The projection 10*f* has moved into engagement with the underside of the leaf spring 26 and has thereby cammed leaf spring 26 overcenter to a position where it is biased against the right cylindrical surface 10*b* on stem 10*a*. As seen in FIG. 4 the push button 10 is depressed to cause contact carrier 8 to drive the bridging contacts 14 into engagement with the stationary contacts 18, 20 by virtue of the connection provided by helical compression drive spring 12 between the push button stem 10*a* and the carrier 8. The combined strength of springs 16 is less than the strength of drive spring 12 so that the carrier 8 is moved downward in response to inward movement of the push button. This movement of the push button causes the surface 10*b* to ride along the leaf spring 26 until such time as the annular shoulder 10*d* moves below the lower edge of leaf spring 26 whereupon the spring moves over the shoulder 10*d* against surface 10*c*. In this position the spring 26 latches the push button 10 down in an intermediate depressed position against the outward bias provided by springs 12 and 16 and maintains the switch contacts in their ON condition. To unlatch the push button 10 and return the switch contacts to their OFF condition the push button 10 is depressed further to a fully depressed position as seen in FIG. 5 to cause the frusto-conical cam surface 10*e* to engage the upper surface of leaf spring 26 thereby camming the leaf spring overcenter to an opposite stable position free of stem 10*a*. Upon release of push button 10, the three springs 12, 16, 16 function to return the carrier 8 and the push button 10 to their extended positions whereupon the radial projection 10*f* engages the underside of leaf spring 26 to cam it back overcenter to bear against the cylindrical surface 10*b* of stem 10*a*.

FIGS. 6–10 show an alternate embodiment of the switch. This embodiment includes a similar molded insulating frame 34, molded insulating base 36, contact carrier 38 and push button 40. The contact carrier 38 includes projections 38*b* on the bottom thereof which serve as guides for bridging contacts 44 biased into position by helical compression springs 46 which extend between the bottom surface of base 36 and the central portion of the bridging contacts 44. A compression drive spring 42 also serves to connect the push button 40 to the contact carrier 38 at the lower end of a push button stem 40*a*.

In this embodiment a leaf spring 66 is mounted in the button receiving opening of the switch frame 34 centrally of the transverse dimension of the opening to extend across the lengthwise dimension of the opening. Leaf spring 66 is oriented in a vertical plane as opposed to the oblique plane of spring 26 to provide more vertical rigidity to the latching function. A separate mounting structure is provided for leaf spring 66 in this version, the structure comprising two identical molded retainer members 68, one of which is pictorially shown in FIG. 12. As viewed in FIGS. 6 and 7, each retainer 68 is shaped to lie adjacent one-half of the peripheral wall of the rectangular opening for button 40 in frame 34. A central boss 68*a* in each retainer 68 has a half-cylindrical recess 68*b* therein and a half longitudinally extending slot 68*c*, and when one retainer 68 is reversed with respect to the other retainer and placed adjacent thereto, the two bosses 68*a* join to form a cylindrical recess for guiding the stem 40*a* of push button 40 and a slot for receiving the central portion of leaf spring 66.

Bosses 68*a* and the outer ends of each retainer 68 are further provided with molded pins and recesses which are complemental to each other when the retainers 68 are reversed, to position the retainers with respect to each other. The pins at the outer ends of the retainers also project through holes in the ends of spring 66 to securely position the spring to the mounting structure. The stem 40*a* of push button 40 is provided with a central opening 40*b* through which the leaf spring 66 extends, the opening 40*b* being provided with latching and camming surfaces to cooperate with the leaf spring in providing the latching and release functions. Button 40, spring 66 and retainer 68 are sub-assembled as a unit and then inserted into the rectangular opening in frame 34 whereupon the walls of the frame 34 hold the members 40, 66 and 68 assembled in a simple and economical assembly step.

Leaf spring 66 is also mounted under compression such that it assumes one of two stable positions on either side of its center position. The internal configuration of the opening 40*b* can best be seen with reference to FIGS. 8–10. In FIG. 9 the switch is shown in its OFF position wherein the contact carrier 38 and push button 40 in their outermost extended position. The leaf spring 66 is to the right of its center and is self-biased toward one stable position whereby it is biased into engagement with an axially extending surface 40*c*. Depression of the push button 40 to operate the switch contacts to their ON position moves surface 40*c* downwardly with respect to leaf spring 66 and causes a shoulder 40*d* to move below the lower edge of the leaf spring 66 whereupon the leaf spring is biased over the top of shoulder 40*d* to latch the button 40 in an intermediate depressed position as shown in FIG. 8. An angular surface 40*e* extends from the stepped surface adjacent shoulder 40*d* and further subsequent depression of the push button 40 to its fully depressed position causes the angular surface 40*e* to cam leaf spring 66 to the left of its center toward its opposite stable position as shown in FIG. 10. Upon release of push button 40, springs 42, 46, 46 return the carrier 38 and push button 40 to their extended position which subsequently causes leaf spring 66 to be cammed back to the initial stable position at the right of center by an angular surface 40*f* adjacent the lower end of the opening 40*b* in push button stem 40*a*.

It will be appreciated that I have provided herein a simple and economical means of providing a latch hold-down device for a push-button switch. The latch features improved rigidity and hold-down strength for the push button and automatic latching function without creating additive camming forces when moving to the latched position. While the apparatus hereinbefore described presents preferred embodiments of the invention and the best mode contemplated at this time for putting it into practice, it is to be understood that the invention is not intended to be confined to the particular embodiments disclosed but that it is susceptible to various modifications without departing from the scope of the appended claims.

I claim:

1. In a push-button switch comprising:

a housing having an opening therein;

a push-button mounted in said opening and having a stem extending into said housing;

spring means biasing said push-button outwardly of said housing; and switch contacts in said housing operable by said push-button;

the improvement comprising:

a leaf spring mounted in said housing and extending across said opening, said leaf spring being mounted under compression to be bistable and being biased against said push-button stem in one stable position;

a latching surface on said stem;

wherein depression of said push-button to an intermediate position operates said switch contacts to an ON condition and moves said latching surface inwardly of said leaf spring, said leaf spring engaging said latching surface to hold said push-button depressed in said intermediate position and said switch contacts operated in said ON condition, and means subsequently operable by said push-button for removing said leaf spring from said latching surface for releasing said push-button.

2. The push-button switch according to claim 1, wherein:

said leaf spring is mounted by fixing the ends thereof within said opening in a space less than the length of said leaf spring to cause the portion of said leaf spring intermediate the ends to be bowed to one side of a straight line between the fixed ends.

3. The push-button switch according to claim 2, wherein:

said subsequently operable means comprises a first cam surface on said push-button stem engageable with said leaf spring upon further depression of said push-button from its latched position for camming said leaf spring to an opposite stable position wherein said leaf spring is free of said latching surface and releases said push-button for return to its original position by said spring means, thereby to operate said switch contacts to an OFF condition, and means for resetting said leaf spring to said one stable position upon return of said push-button to said original position.

4. The push-button switch according to claim 3, wherein:

said push button stem includes a second cam surface engageable with said leaf spring upon outward return movement of said push button for camming said leaf spring to said one stable position after said latching surface has moved beyond said leaf spring.

5. The push-button switch according to claim 4, wherein:

said push button stem has a transverse opening which receives the intermediate portion of said leaf spring, said latching surface and said first and second cam surfaces being on the sidewalls forming said opening in said stem.

6. The push-button switch according to claim 5, wherein:

the sidewall portion of said opening adjacent said latching surface and inward thereof is parallel to the direction of movement of said push button when being depressed.

7. The push-button switch according to claim 5, wherein:

said leaf spring ends are mounted in a separate retaining means which is insertable into said opening of said housing.

8. The push-button switch according to claim 7, wherein:

said retaining means comprises a pair of complimentally formed members assembled together to secure the ends of said leaf spring therebetween, said members being held assembled when inserted in said opening of said housing by walls of said housing defining said opening.

9. The push-button switch according to claim 2, wherein:

said subsequently operable means comprises a first cam surface on said push-button stem positioned outwardly of said latching surface, said first cam surface engaging said leaf spring and camming it to an opposite stable position upon further depression of said push-button from the latched position thereof, said leaf spring when in said opposite stable position being free of said latching surface and releasing said push-button for return to its original position by said spring means, thereby to operate said switch contacts to an OFF condition, and means for resetting said leaf spring to said one stable position upon return of said push-button to said original position.

10. The push-button switch according to claim 9, wherein:

said push button stem includes a second cam surface positioned inwardly of said latching surface, said second cam surface engaging said leaf spring and camming it to said one stable position upon outward return movement of said push button by said spring means.

11. The push-button switch according to claim 10, wherein:

said latching surface and said first and second cam surfaces are formed along one side of said push button stem and said leaf spring is positioned adjacent said one side.

12. The push-button switch according to claim 11, wherein:

said latching surface comprises a transverse shoulder connecting a first and a second surface, which first and second surfaces are parallel to the direction of movement of said push button when being depressed.

13. The push-button switch according to claim 12, wherein:

said second cam surface comprises a lateral projection formed from said first surface and spaced inwardly therealong.

14. The push-button switch according to claim 4, wherein:

a resilient operating connection is provided between the inner end of said push button stem and said switch contacts.

15. The push-button switch according to claim 14, wherein:

said switch contacts comprise a contact carrier guided for reciprocal movement in said housing, bridging contacts carried by said contact carrier, stationary contacts mounted in said housing, and means biasing said bridging contacts and said contact carrier away from said stationary contacts, and said resilient connection comprises a drive spring carried by the inner end of said push button stem and engaging said contact carrier, and wherein depression of said push button causes said drive spring to drive said contact carrier inwardly to cause said bridging contacts to engage said stationary contacts, said drive spring overcoming the bias of said means biasing said bridging contacts and said contact carrier away from said stationary contacts.

16. The push-button switch according to claim 15, wherein:

said spring means biasing said push button outwardly of said housing comprises said drive spring and said means biasing said bridging contacts and said contact carrier away from said stationary contacts.

* * * * *